US011308842B2

(12) United States Patent
Kim et al.

(10) Patent No.: US 11,308,842 B2
(45) Date of Patent: Apr. 19, 2022

(54) DISPLAY DRIVING APPARATUS AND CURRENT BIAS CIRCUIT THEREOF

(71) Applicant: Silicon Works Co., Ltd., Daejeon (KR)

(72) Inventors: Young Bok Kim, Daejeon (KR); Taiming Piao, Daejeon (KR); Young Tae Kim, Daejeon (KR); Dong Hun Lee, Daejeon (KR)

(73) Assignee: Silicon Works Co., Ltd

( * ) Notice: Subject to any disclaimer, the term of this patent is extended or adjusted under 35 U.S.C. 154(b) by 0 days.

(21) Appl. No.: 17/368,590

(22) Filed: Jul. 6, 2021

(65) Prior Publication Data

US 2022/0005394 A1 Jan. 6, 2022

(30) Foreign Application Priority Data

Jul. 6, 2020 (KR) ..... 10-2020-0082597

(51) Int. Cl.
*G09G 3/20* (2006.01)
*G05F 3/24* (2006.01)

(52) U.S. Cl.
CPC ..... *G09G 3/20* (2013.01); *G05F 3/24* (2013.01); *G09G 2330/04* (2013.01)

(58) Field of Classification Search
CPC ..... G09G 3/20; G09G 2310/0275; G09G 2330/028; G09G 3/3283
See application file for complete search history.

(56) References Cited

U.S. PATENT DOCUMENTS

2015/0338931 A1* 11/2015 Teh ..... G06F 3/0354 345/166
2017/0104031 A1* 4/2017 Clark ..... H01L 45/1233
2018/0226019 A1* 8/2018 Tong ..... G09G 3/3225
2020/0280308 A1* 9/2020 Gunasekaran ..... G01R 31/2621

FOREIGN PATENT DOCUMENTS

KR 2016-0070314 A 6/2016

* cited by examiner

*Primary Examiner* — Gerald Johnson
(74) *Attorney, Agent, or Firm* — Polsinelli PC

(57) ABSTRACT

The present disclosure discloses a display driving apparatus configured to process data by using a low voltage bias current, process a source signal by using a high voltage bias current, and provide the low voltage bias current and the high voltage bias current by using one bias core.

15 Claims, 5 Drawing Sheets

DISPLAY DRIVING APPARATUS AND CURRENT BIAS CIRCUIT THEREOF

BACKGROUND

1. Technical Field

The present disclosure relates to a display driving apparatus, and more particularly, to a display driving apparatus for processing data by using a bias current and providing a source signal for a display and a current bias circuit of a display driving apparatus for providing the bias current.

2. Related Art

A display apparatus includes a display panel for displaying a screen, such as an LCD panel or an LED panel, and a display driving apparatus for driving the display panel.

Among the display panel and the display driving apparatus, the display driving apparatus is fabricated as an integrated circuit and configured to process data for a display, which is provided from the outside, and to provide the display panel with a source signal corresponding to the data. The display panel may display a screen in response to the source signal of the display driving apparatus.

The display driving apparatus is designed to include a low voltage bias core for low voltage power and a high voltage bias core for high voltage power. The low voltage bias core is used to generate a low voltage bias current. The low voltage bias current is used to process data, that is, a digital signal. Furthermore, the high voltage bias core is used to generate a high voltage bias current. The high voltage bias current is used to process a source signal, that is, an analog signal.

As described above, the display driving apparatus requires the two bias cores for the high voltage power and the low voltage power. Therefore, the display driving apparatus has limitations in reducing a chip area thereof because it requires an area for the two bias cores and the addition of parts for the two bias cores.

Furthermore, it is difficult to implement a circuit for generating the high voltage bias current in a way to precisely control a current compared to a circuit for generating the low voltage bias current. Accordingly, a common display driving apparatus has difficulty in precisely controlling the high voltage bias current.

Therefore, there is a need to develop a display driving apparatus to solve the aforementioned problem.

SUMMARY

Various embodiments are directed to providing a display driving apparatus capable of reducing an area and the number of parts thereof by providing a low voltage bias current and a high voltage bias current by using one bias core, and a current bias circuit thereof.

Furthermore, various embodiments are directed to providing a display driving apparatus capable of providing a low voltage bias current and a high voltage bias current by using a low voltage core, and precisely controlling the high voltage bias current through control of the low voltage bias current, and a current bias circuit thereof.

Furthermore, various embodiments are directed to providing a display driving apparatus for generating a high voltage bias current by using a low voltage bias current, and stably maintaining protection for a low voltage device, which receives the low voltage bias current, even in a change in a voltage environment according to a power sequence, and a current bias circuit thereof.

In an embodiment, a display driving apparatus may include a bias core configured to provide a core current based on low voltage power, a low voltage bias unit configured to generate a low voltage bias current in response to the core current, a current conversion circuit configured to generate a transfer current based on a driving voltage for high voltage power in response to the core current, a high voltage bias unit configured to generate a high voltage bias current based on the driving voltage in response to the transfer current, and a signal driving circuit configured to output a source signal corresponding to data for a display, perform first bias control for processing the data by using the low voltage bias current, and perform second bias control for processing the source signal by using the high voltage bias current.

In an embodiment, a current bias circuit of a display driving apparatus may include a bias core configured to provide a core current based on low voltage power, a current conversion circuit configured to generate a transfer current based on a driving voltage for high voltage power in response to the core current, and a high voltage bias unit configured to generate a high voltage bias current based on the driving voltage in response to the transfer current, wherein the current conversion circuit is driven by the driving voltage for the high voltage power and a first ground voltage for the low voltage power.

The display driving apparatus of the present disclosure can provide a low voltage bias current for processing data and a high voltage bias current for processing a source signal by using one bias core. Accordingly, an area and the number of parts for configuring the display driving apparatus can be reduced.

Furthermore, the display driving apparatus of the present disclosure can provide a low voltage bias current and a high voltage bias current by using a low voltage core. Accordingly, the display driving apparatus has an advantage in that it can precisely control the high voltage bias current through control of the low voltage bias current.

Furthermore, the display driving apparatus of the present disclosure can use a low voltage device in order to generate a high voltage bias current by using a low voltage bias current, and can prevent the low voltage device for receiving the low voltage bias current from being damaged by the influence of a driving voltage, that is, a high voltage. Accordingly, the display driving apparatus of the present disclosure has an effect in that it can secure safety and reliability.

DETAILED DESCRIPTION

Figure 1:
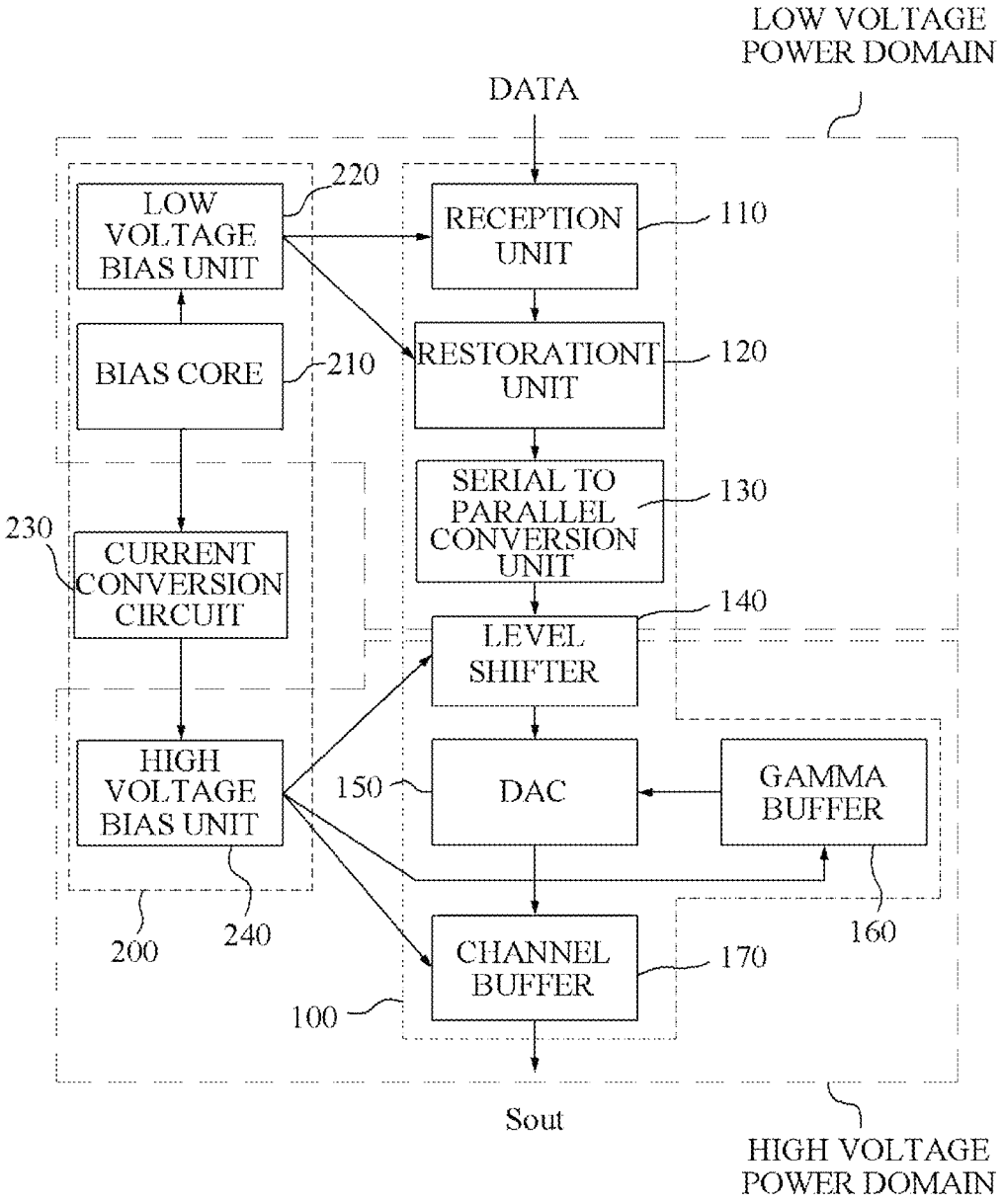
FIG. 1 is a block diagram illustrating a display driving apparatus according to a preferred embodiment of the present disclosure.

A display driving apparatus of the present disclosure may be described with reference to FIG. 1.

The display driving apparatus includes a signal driving circuit 100 and a current bias circuit 200.

First, the signal driving circuit 100 is configured to receive data DATA for displaying a screen from an external source, such as a timing controller (not illustrated), generate a source signal Sout corresponding to the data DATA, and output the source signal Sout.

To this end, the signal driving circuit 100 may include a reception unit 110, a restoration unit 120, a serial to parallel conversion unit 130, a level shifter 140, a digital-to-analog converter (DAC) 150, a gamma buffer 160, and a channel buffer 170.

In this case, the reception unit 110 interfaces with an external transmission line (not illustrated), and is configured to receive the data DATA and to provide the received data DATA to the restoration unit 120 in order to restore the received data DATA. It may be understood that the reception unit 110 defines an interface unit which receives the data DATA of the transmission line and delivers the received data DATA to the restoration unit 120.

Furthermore, the restoration unit 120 separates and restores display data, a clock signal and control data included in the data DATA. The clock signal and the control data restored by the restoration unit 120 may be used to process the data DATA and a source signal, but a detailed illustration and description thereof are omitted. The restoration unit 120 is configured to provide the serial to parallel conversion unit 130 in series with the restored display data for each channel.

The serial to parallel conversion unit 130 is configured to align serial display data in latches in parallel by sequentially latching the serial display data in the latches, and to provide the level shifter 140 with the display data latched in parallel.

The level shifter 140 is configured to shift a level of display data in a low voltage power domain to a level of display data in a proper high voltage power domain for the input of the display data to the DAC 150, and to provide the DAC 150 with the display data whose level has shifted.

The low voltage power domain may be defined as a domain between an operating voltage VCC and a first ground voltage VSS. It may be understood that low voltage power provides the operating voltage VCC and the first ground voltage VSS. Furthermore, the high voltage power domain may be defined as a domain between a driving voltage VDDH and a second ground voltage VSSH. It may be understood that high voltage power provides the driving voltage VDDH and the second ground voltage VSSH. In this case, the high voltage power domain may be set to have a wider voltage width than the low voltage power domain. The driving voltage VDDH may be higher than the operating voltage VCC. The second ground voltage VSSH may be equal to or different from the first ground voltage VSS.

The DAC 150 is configured to receive gamma voltages from the gamma buffer 160, select a gamma voltage having gradation corresponding to display data, and output the selected gamma voltage to the channel buffer 170 as the source signal Sout.

The channel buffer 170 is configured to amplify the source signal Sout output by the DAC 150 so that the source signal has a proper level to be provided to a display panel (not illustrated), and to output the amplified source signal Sout to the display panel.

The reception unit 110, the restoration unit 120, the serial to parallel conversion unit 130, and the level shifter 140 are for processing display data, that is, a digital signal. The DAC 150, the gamma buffer 160, and the channel buffer 170 are for processing a source signal.

Among them, the reception unit 110, the restoration unit 120, the serial to parallel conversion unit 130, and the input side of the level shifter 140 operate in the low voltage power domain. The output side of the level shifter 140, the DAC 150, the gamma buffer 160, and the channel buffer 170 operate in the high voltage power domain.

Furthermore, the reception unit 110 and the restoration unit 120 perform bias control for processing data. To this end, the reception unit 110 and the restoration unit 120 require a low voltage bias current. Furthermore, the level shifter 140, the gamma buffer 160, and the channel buffer 170 perform bias control for processing a source signal. To this end, the level shifter 140, the gamma buffer 160, and the channel buffer 170 require a high voltage bias current.

As described above, the signal driving circuit 100 is configured to output the source signal Sout corresponding to data DATA for a display, perform first bias control for processing the data DATA by using a low voltage bias current, and perform second bias control for processing the source signal Sout by using a high voltage bias current.

The current bias circuit 200 is configured to generate a low voltage bias current and a high voltage bias current by using one bias core 210, and to provide the low voltage bias current and the high voltage bias current to necessary parts of the signal driving circuit 100.

To this end, the current bias circuit 200 may include the bias core 210, a low voltage bias unit 220, a current conversion circuit 230, and a high voltage bias unit 240.

The bias core 210 is configured to generate a core current by low voltage power and to provide the core current to the low voltage bias unit 220 and the current conversion circuit 230.

The low voltage bias unit 220 may be configured to generate a low voltage bias current in response to a core current, and to provide the low voltage bias current to the reception unit 110 and the restoration unit 120.

The current conversion circuit 230 is configured to generate a low voltage bias reference current based on an operating voltage for low voltage power in response to a core current of the bias core 210, and to generate a transfer current based on a driving voltage having high voltage power in response to the low voltage bias reference current.

Furthermore, the high voltage bias unit 240 is configured to generate a high voltage bias current based on a driving voltage in response to a transfer current of the current conversion circuit 230, and to provide the high voltage bias current to the level shifter 140, the gamma buffer 160, and the channel buffer 170.

Among them, the bias core 210 and the low voltage bias unit 220 operate in the low voltage power domain. The high voltage bias unit 240 operates in the high voltage power domain. That is, it may be understood that the bias core 210 and the low voltage bias unit 220 are driven using the operating voltage VCC and the first ground voltage VSS for low voltage power. It may be understood that the high voltage bias unit 240 is driven using the driving voltage VDDH and the second ground voltage VSSH for high voltage power. Furthermore, in an embodiment, the current conversion circuit 230 is configured to be driven using the driving voltage VDDH and the first ground voltage VSS.

An example of the bias core 210, the current conversion circuit 230, and the high voltage bias unit 240 is described with reference to FIG. 2.

The bias core 210 is driven by low voltage power that provides the operating voltage VCC and the first ground voltage VSS, and includes a low voltage core 212 and a driving device ML1.

The low voltage core 212 may be understood as a circuit acting as a source that provides a source current in accordance with low voltage power.

The driving device ML1 is configured using a PMOS transistor, and is a low voltage device operating in the range of the operating voltage VCC and the first ground voltage VSS for low voltage power. More specifically, the driving device ML1 is configured to have a drain to which the low voltage core 212 is connected, the drain and a gate connected in common, and a source to which the operating voltage VCC is applied. The driving device ML1 is turned on because a voltage level of the gate thereof drops to a low level by the source current of the low voltage core 212, and generates a core current.

The bias core 210 is configured to provide a core current to a first low voltage device ML2 of the current conversion circuit 230 through a node to which the drain and gate of the driving device ML1 are connected in common.

Furthermore, the current conversion circuit 230 includes a reference current generator 232 and a transfer current generator 234.

In this case, the reference current generator 232 is configured to generate a low voltage bias reference current ILV based on the operating voltage VCC in response to a core current of the bias core 210.

More specifically, the reference current generator 232 includes low voltage devices ML2 and ML3 connected in series. The low voltage devices ML2 and ML3 are devices operating in the range of the operating voltage VCC and the first ground voltage VSS for low voltage power. The low voltage device ML2 is configured using a PMOS transistor. The low voltage device ML3 is configured using an NMOS transistor.

Among them, the low voltage device ML2 has a gate to which a core current of the bias core 210 is provided, and is configured to generate the low voltage bias reference current ILV based on the operating voltage VCC in response to the core current. More specifically, the low voltage device ML2 is turned on because a voltage level of the gate thereof drops to a low level by the core current, and generates the low voltage bias reference current ILV by the operating voltage VCC applied to the source of the low voltage device ML2.

Furthermore, the low voltage device ML3 is turned on in response to the low voltage bias reference current ILV, and is configured to provide the transfer current generator 234 with a turn-on voltage corresponding to the low voltage bias reference current ILV. More specifically, the low voltage device ML3 is configured to have a drain to which the low voltage bias reference current ILV is provided, the drain and a gate connected in common, and a source to which the first ground voltage VSS is applied. The low voltage device ML3 provides a low voltage device MLC of the transfer current generator 234 with a turn-on voltage corresponding to the low voltage bias reference current ILV of the low voltage device ML2.

The transfer current generator 234 includes the low voltage device MLC for receiving the low voltage bias reference current ILV, and is configured to generate a transfer current It based on the driving voltage VDDH in response to the turn-on of the low voltage device MLC, and to perform protection for dropping the driving voltage VDDH applied to the low voltage device MLC.

To this end, the transfer current generator 234 includes the low voltage device MLC, a high voltage device MH1, and a protection device MHD.

The low voltage device MLC is a device operating in the range of the operating voltage VCC and the first ground voltage VSS for low voltage power, and is configured using an NMOS transistor. More specifically, the low voltage device MLC is configured to have a source to which the first ground voltage VSS is applied, a drain connected to the protection device MHD, and a gate to which a turn-on voltage of the low voltage device ML3 is provided. The low voltage device MLC is turned on in response to the turn-on voltage of the low voltage device ML3 applied to the gate thereof, and controls the generation of the transfer current It by turning on the high voltage device MH1.

The protection device MHD is a device operating in the range of the driving voltage VDDH and the first ground voltage VSS, and is configured using an NMOS transistor. More specifically, the protection device MHD is configured to have a source connected to the drain of the low voltage device MLC, a gate to which the operating voltage VCC is applied, and a drain connected to the high voltage device MH1. The protection device MHD is configured so that the first ground voltage VSS applied through the low voltage device MLC is used as a back bias voltage. The protection device MHD is turned on in response to the operating voltage VCC, and connects the low voltage device MLC and the high voltage device MH1, drops the driving voltage VDDH, and delivers the dropped driving voltage VDDH to the low voltage device MLC.

Furthermore, the high voltage device MH1 is a device operating in the range of the driving voltage VDDH and the first ground voltage VSS, and is configured using a PMOS transistor. More specifically, the high voltage device MH1 is configured to have a drain connected to the drain of the protection device MHD, the drain and a gate connected in common, and a source to which the driving voltage VDDH is applied. When the low voltage device MLC is turned on in response to the low voltage bias reference current ILV, the high voltage device MH1 is turned on because a voltage level of the gate of the high voltage device MH1 drops to a low level, and generates the transfer current It by the driving voltage VDDH applied to the source of the high voltage device MH1. Furthermore, the high voltage device MH1 delivers, to the high voltage bias unit 240, a turn-on voltage corresponding to the transfer current It.

The high voltage bias unit 240 includes high voltage devices MH9 and MH10 connected in series. The high voltage devices MH9 and MH10 are devices operating in the range of the driving voltage VDDH and the second ground voltage VSSH having high voltage power. The high voltage device MH9 is configured using a PMOS transistor. The high voltage device MH10 is configured using an NMOS transistor.

Among them, the high voltage device MH9 is configured to have a gate to which a turn-on voltage of the transfer current generator 234 is provided, and to generate a high voltage bias current IHV based on the driving voltage VDDH by the turn-on of the high voltage device MH9. More specifically, when a level of the turn-on voltage of the transfer current generator 234 is a low level, the high voltage device MH9 is turned on and generates the high voltage bias current IHV based on the driving voltage VDDH applied to a source of the high voltage device MH9.

Furthermore, the high voltage device MH10 is turned on in response to the high voltage bias current IHV, and is configured to drive the high voltage bias current IHV. More specifically, the high voltage device MH10 is configured to have a drain to which the high voltage bias current IHV is provided, the drain and a gate connected in common, and a source to which the second ground voltage VSSH is applied.

The high voltage device MH10 is turned on in response to the high voltage bias current IHV of the high voltage device MH9.

Figure 2:
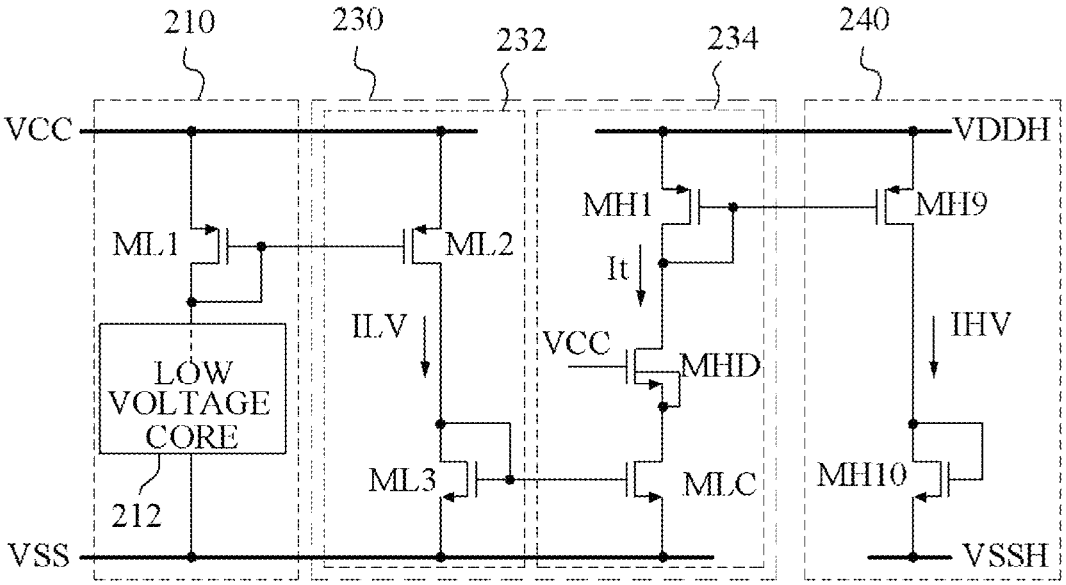
FIG. 2 is a circuit diagram illustrating an example of a current conversion circuit.

In the embodiment of FIG. 2, according to the above construction, the current conversion circuit 230 may generate the low voltage bias reference current ILV in response to a core current of the bias core 210, and may generate the transfer current It corresponding to the low voltage bias reference current ILV. The high voltage bias unit 240 may generate the high voltage bias current IHV in response to the transfer current It.

The embodiment of FIG. 2 can provide a low voltage bias current and a high voltage bias current by using one bias core.

Furthermore, the embodiment of FIG. 2 generates a high voltage bias current by using a low voltage bias reference current which can be precisely controlled. Therefore, the high voltage bias current can be effectively controlled through precise control of the low voltage bias reference current.

Furthermore, in the embodiment of FIG. 2, the driving voltage VDDH, that is, a high voltage, is dropped by the protection device MHD turned on in a process of generating the high voltage bias current, and is applied to the low voltage device ML3. Therefore, the low voltage device ML3 can be driven in a safe voltage environment in which the low voltage device ML3 is not influenced.

Figure 3:
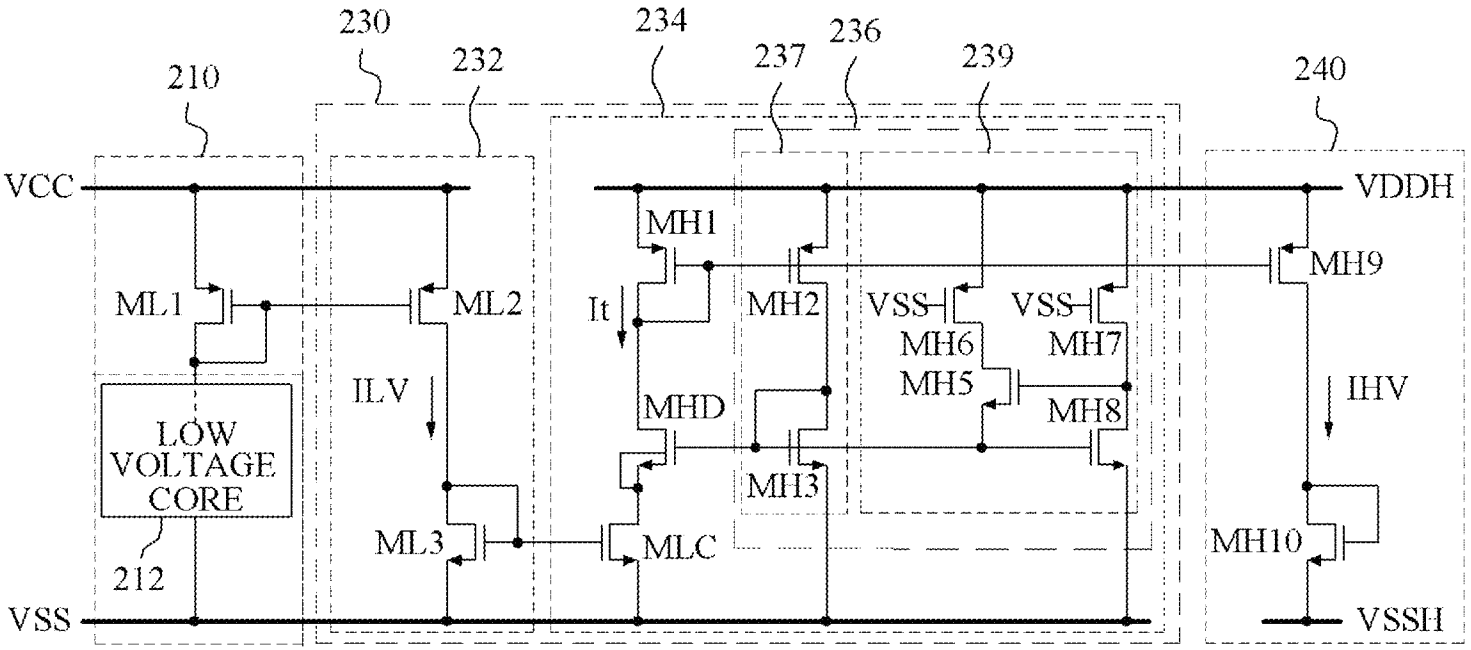
FIG. 3 is a circuit diagram illustrating another example of the current conversion circuit.

The operating voltage VCC may be formed to be low. In this case, in the embodiment of FIG. 2, it is difficult for the protection device MHD to maintain a normal turn-on. In order to prevent this, the embodiment of FIG. 3 may be implemented. In FIG. 3, since a bias core 210, a high voltage bias unit 240, and a reference current generator 232 are configured to be the same as those of FIG. 2, redundant descriptions of the configurations and operations of these elements are omitted.

In FIG. 3, a transfer current generator 234 is configured to include a low voltage device MLC, a high voltage device MH1, a protection device MHD, and a protection control circuit 236.

Since the low voltage device MLC and the high voltage device MH1 are constructed and operated in the same manner as those of FIG. 2, redundant descriptions thereof are omitted.

In FIG. 3, the protection device MHD is configured between the low voltage device MLC and the high voltage device MH1, and is configured to maintain its turn-on by a protection voltage provided through a high voltage device MH3. As in FIG. 3, the protection device MHD is configured to drop the driving voltage VDDH and deliver the dropped driving voltage VDDH to the low voltage device MLC.

As in FIG. 3, the protection device MHD is a device operating in the range of the driving voltage VDDH and the first ground voltage VSS, and is configured using an NMOS transistor. More specifically, the protection device MHD is configured to have a source connected to a drain of the low voltage device MLC, a gate to which a protection current of the protection control circuit 236 is provided, and a drain connected to the high voltage device MH1. The protection device MHD is configured so that the first ground voltage VSS applied through the low voltage device MLC is used as a back bias voltage. The protection device MHD is turned on in response to a protection voltage provided through the high voltage device MH3, and connects the low voltage device MLC and the high voltage device MH1, drops the driving voltage VDDH, and delivers the dropped driving voltage VDDH to the low voltage device MLC.

If the operating voltage VCC is not formed, the low voltage device MLC is turned off, and a transfer current It is not formed. Furthermore, after a lapse of the initial stage, the driving voltage VDDH and the operating voltage VCC may each have a normal level. In this case, the low voltage device MLC is turned on, and the transfer current It is formed.

The protection control circuit 236 is configured to generate a protection voltage based on the transfer current It or the driving voltage VDDH depending on whether the transfer current It is formed, and to provide the protection voltage to the gate of the protection device MHD.

To this end, the protection control circuit 236 includes a core protection circuit 237 and a sub-protection circuit 239.

When the transfer current It flows as the low voltage device MLC is turned on because the operating voltage VCC has a normal level, the core protection circuit 237 generates a core protection current based on the driving voltage VDDH in response to the transfer current It. To this end, the core protection circuit 237 includes a high voltage device MH2 and the high voltage device MH3. The high voltage device MH2 is configured using a PMOS transistor operating in the range of the driving voltage VDDH and the first ground voltage VSS. The high voltage device MH3 is configured using an NMOS transistor operating in the range of the driving voltage VDDH and the first ground voltage VSS.

More specifically, the high voltage device MH2 is configured to have a drain connected to the drain of the high voltage device MH3, a gate connected to the gate of the high voltage device MH1, and a source to which the driving voltage VDDH is applied. When a voltage level of the gate of the high voltage device MH2 drops to a low level by the transfer current It, the high voltage device MH2 is turned on, and generates a core protection current based on the driving voltage VDDH applied to the source thereof and provides the core protection current to the high voltage device MH3.

The high voltage device MH3 is configured to have a drain and a gate connected in common, the drain connected to the drain of the high voltage device MH2, and a source to which the first ground voltage VSS is applied. The high voltage device MH3 provides the protection device MHD with a protection voltage corresponding to a core protection current of the high voltage device MH2.

The sub-protection circuit 239 generates a protection voltage based on the driving voltage VDDH. To this end, the sub-protection circuit 239 includes a first switching device MH6, a second switching device MH7, a first sub-protection device MH5, and a second sub-protection device MH8.

Each of the first switching device MH6 and the second switching device MH7 is configured using a PMOS transistor operating in the range of the driving voltage VDDH and the first ground voltage VSS. The first switching device MH6 and the second switching device MH7 are configured to receive the driving voltage VDDH in parallel and to act as resistance by being turned on in response to the first ground voltage VSS for low voltage power, which is applied to the gates thereof.

The first sub-protection device MH5 is configured using an NMOS transistor operating in the range of the driving voltage VDDH and the first ground voltage VSS. The first sub-protection device MH5 is configured to have a drain connected to the drain of the first switching device MH6, a gate connected to the common drain of the second switching device MH7 and the second sub-protection device MH8, and a source connected to the gate of the protection device MHD in common along with the high voltage device MH3.

The second sub-protection device MH8 is configured using an NMOS transistor operating in the range of the driving voltage VDDH and the first ground voltage VSS. The second sub-protection device MH8 is configured to have a drain connected to the drain of the second switching device MH7, a gate connected to the source of the first sub-protection device MI-IS and the gate of the protection device MHD, and a source to which the first ground voltage VSS is applied.

If the transfer current It flows in accordance with a case where a level of the operating voltage VCC is a normal level, so that a voltage level of the gate of the protection device MHD is high, the second sub-protection device MH8 is turned on. On the contrary, if the transfer current It does not flow because the operating voltage VCC is not formed, so that a voltage level of the gate of the protection device MHD is low, the second sub-protection device MH8 is turned off.

When the second sub-protection device MH8 is turned on, the first sub-protection device MH5 maintains an off state and does not provide a protection voltage to the gate of the protection device MHD. On the contrary, when the second sub-protection device MH8 is turned off, the first sub-protection device MH5 is turned on in response to the driving voltage VDDH applied through the second switching device MH7, and applies, to the gate of the protection device MHD, a protection voltage based on the driving voltage VHHD. At this time, the protection device MHD may maintain the turn-on in response to the protection voltage of the first sub-protection device MH5.

As described above, when both the driving voltage VDDH and the operating voltage VCC have a normal high level, the current conversion circuit according to the embodiment of FIG. 3 provides a high voltage bias current by forming the transfer current It. At this time, the protection device MHD may maintain the turn-on in response to the protection voltage based on the transfer current It, and prevent the driving voltage VDDH from being directly applied to the low voltage device MLC. Furthermore, when the driving voltage VDDH has a normal high level and the operating voltage VCC is not formed, in the embodiment of FIG. 3, the protection device MHD may maintain the turn-on in response to the protection voltage based on the driving voltage VDDH, and prevent the driving voltage VDDH from being directly applied to the low voltage device MLC.

Figure 4:
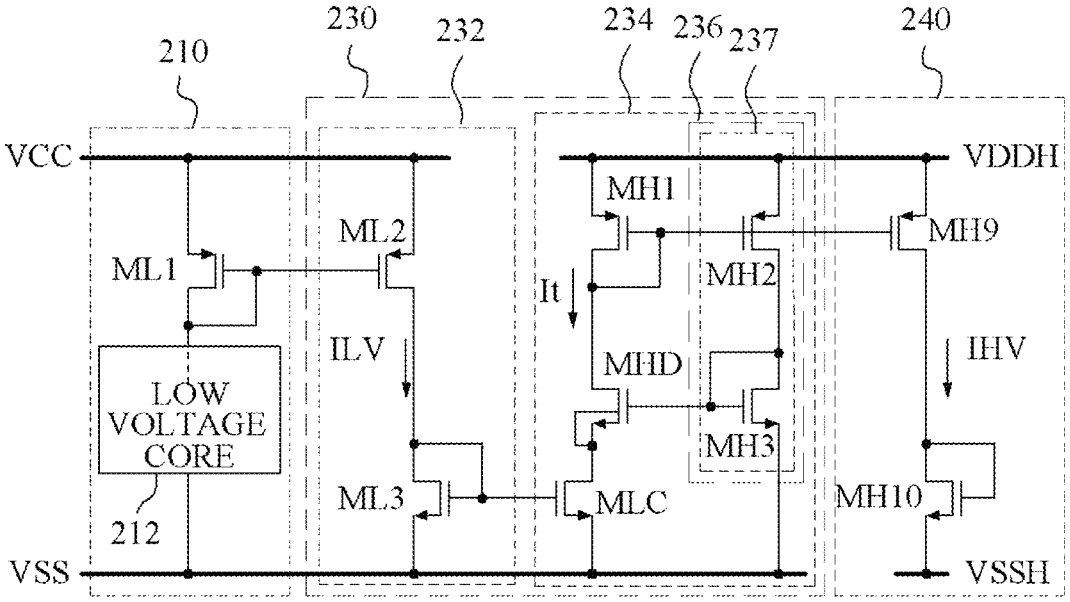
FIG. 4 is a circuit diagram for describing a core protection operation of the current conversion circuit of FIG. 3.
Figure 5:
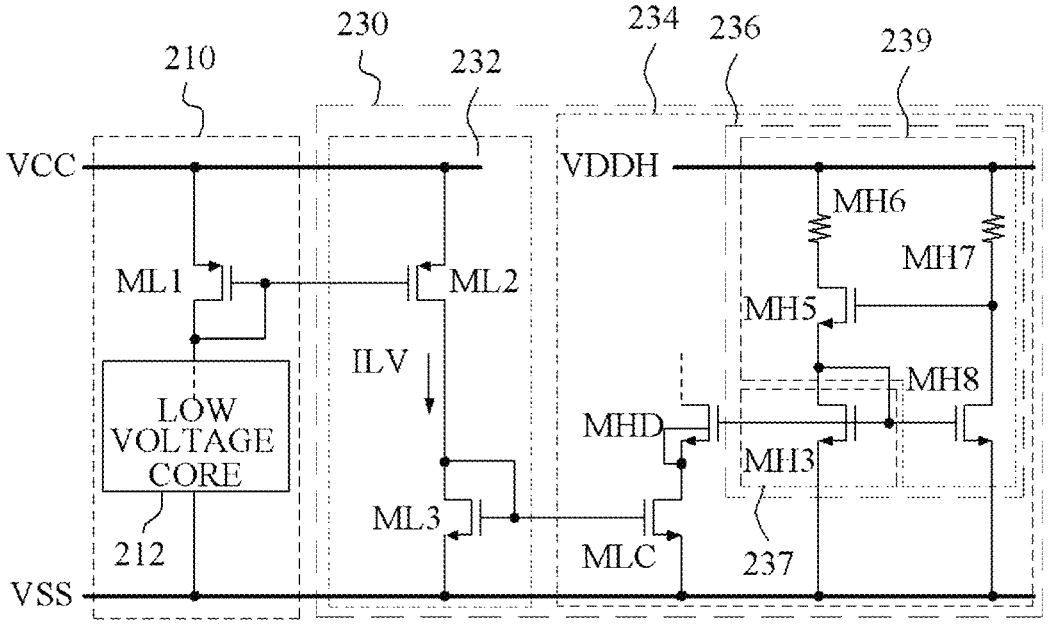
FIG. 5 is a circuit diagram for describing a sub-protection operation of the current conversion circuit of FIG. 3.

This is described with reference to FIGS. 4 and 5. FIG. 4 corresponds to a case where both the driving voltage VDDH and the operating voltage VCC have a normal high level and the low voltage device MLC is turned on in response to the low voltage bias reference current ILV. Furthermore, FIG. 5 corresponds to a case where a level of the driving voltage VDDH is a high level and the operating voltage VCC is not formed. In FIGS. 4 and 5, the same parts as those of FIG. 3 are assigned the same reference numerals, and redundant descriptions thereof are omitted.

When both the driving voltage VDDH and the operating voltage VCC have a normal high level, an operation of the current conversion circuit according to of the embodiment of FIG. 3 may be described with reference to FIG. 4.

Since the operating voltage VCC for low voltage power has a normal high level, the current conversion circuit 230 generates the low voltage bias reference current ILV corresponding to a core current and the transfer current It corresponding to the low voltage bias reference current ILV normally.

That is, the transfer current generator 234 generates the transfer current It corresponding to the low voltage bias reference current ILV normally. In this case, as the transfer current It is formed, the protection control circuit 236 generates a core protection current based on the high voltage device MH2 and provides a protection voltage of the high voltage device MH3 corresponding to the core protection current. Therefore, the protection device MHD may maintain a turn-on in response to the protection voltage of the high voltage device MH3, and drop the driving voltage VDDH, that is, a high voltage, and deliver the dropped driving voltage to the low voltage device MLC. As a result, damage to the low voltage device MLC attributable to the driving voltage VDDH can be prevented.

The sub-protection circuit 239 is not illustrated in FIG. 4 because the sub-protection circuit 239 does not provide a protection voltage and thus does not influence an operation of the protection device MHD.

If a level of the driving voltage VDDH is provided as a high level and the operating voltage VCC is not formed, an operation of the current conversion circuit according to the embodiment of FIG. 3 may be described with reference to FIG. 5. In FIG. 5, the operating voltage VCC may be assumed to be 0 V.

Since the operating voltage VCC for low voltage power is 0 V, the current conversion circuit 230 does not generate the low voltage bias reference current ILV and does not generate the transfer current It corresponding to the low voltage bias reference current ILV.

In this case, the high voltage device MH1 of the transfer current generator 234 and the high voltage device MH2 of the core protection circuit 237 are not turned on because the transfer current It is not generated. That is, the core protection circuit 237 does not provide a protection voltage. The high voltage device MH1 and the high voltage device MH2 are not illustrated in FIG. 5 because they do not influence an operation of the protection control circuit 236.

The protection control circuit 236 does not generate the transfer current It. Therefore, the sub-protection circuit 239 generates a protection voltage based on the driving voltage VHDD.

More specifically, in the sub-protection circuit 239, the first switching device MH6 and the second switching device MH7 are turned on in response to the first ground voltage VSS for low voltage power, thus acting as resistance. Furthermore, the second sub-protection device MH8 is turned off in response to a voltage level of the gate of the protection device MHD, which drops because the transfer current It is not formed. At this time, since the second sub-protection device MH8 is turned off, the driving voltage VDDH is applied to the gate of the first sub-protection device MH5 through the second switching device MH7.

The first sub-protection device MH5 of the sub-protection circuit 239 may be turned on in response to the driving voltage VDDH applied thereto, and may provide the gate of the protection device MHD with a protection voltage based on the driving voltage VDDH.

Therefore, the protection device MHD can maintain a turn-on in response to the protection voltage provided by the first sub-protection device MH5.

As in FIG. 5, even though a level of the driving voltage VDDH is provided as a high level and the operating voltage VCC is not formed, the protection device MHD may be turned on, and prevent the driving voltage VDDH from being applied to the low voltage device MLC.

Accordingly, the display driving apparatus of the present disclosure can provide a low voltage bias current and a high voltage bias current by using the low voltage core, and can prevent a low voltage device for generating a high voltage bias current by using the low voltage bias current from being damaged due to the influence of a high voltage.

Furthermore, the display driving apparatus of the present disclosure can generate a high voltage bias current by using a low voltage bias current, and can maintain protection for a low voltage device that receives a low voltage bias current, regardless of whether a level of the operating voltage VCC is normal. Accordingly, the display driving apparatus of the present disclosure has an effect in that safety and reliability can be secured.

What is claimed is:

1. A display driving apparatus comprising:

a bias core configured to provide a core current based on low voltage power;

a low voltage bias unit configured to generate a low voltage bias current in response to the core current;

a current conversion circuit configured to generate a transfer current based on a driving voltage for high voltage power in response to the core current;

a high voltage bias unit configured to generate a high voltage bias current based on the driving voltage in response to the transfer current; and a signal driving circuit configured to output a source signal corresponding to data for a display, perform first bias control for processing the data by using the low voltage bias current, and perform second bias control for processing the source signal by using the high voltage bias current.

2. The display driving apparatus of claim 1, wherein the current conversion circuit comprises:

a reference current generator configured to generate a low voltage bias reference current based on an operating voltage for the low voltage power in response to the core current; and a transfer current generator comprising a first low voltage device turned on in response to the low voltage bias reference current, and configured to generate the transfer current based on the driving voltage in response to the low voltage bias reference current, and to perform protection for dropping the driving voltage applied to the first low voltage device.

3. The display driving apparatus of claim 2, wherein the reference current generator comprises:

a second low voltage device configured to generate the low voltage bias reference current based on the operating voltage in response to the core current; and a third low voltage device turned on in response to the low voltage bias reference current and configured to provide the low voltage bias reference current to the transfer current generator.

4. The display driving apparatus of claim 2, wherein the transfer current generator comprises:

the first low voltage device turned on in response to the low voltage bias reference current;

a first high voltage device configured to generate the transfer current based on the driving voltage in response to the turn-on of the first low voltage device; and a protection device configured to maintain a turn-on between the first low voltage device and the first high voltage device and perform protection for dropping the driving voltage applied to the first low voltage device.

5. The display driving apparatus of claim 4, wherein the protection device is turned on in response to the operating voltage lower than the driving voltage.

6. The display driving apparatus of claim 2, wherein the transfer current generator comprises:

the first low voltage device turned on in response to the low voltage bias reference current;

a first high voltage device configured to generate the transfer current based on the driving voltage in response to the turn-on of the first low voltage device; and a protection device configured between the first low voltage device and the first high voltage device, and configured to maintain a turn-on in response to a protection voltage and to perform protection for dropping the driving voltage applied to the first low voltage device; and a protection control circuit configured to provide the protection voltage based on the transfer current or the driving voltage depending on whether the transfer current is formed.

7. The display driving apparatus of claim 6, wherein the protection control circuit comprises:

a core protection circuit configured to generate and provide the protection voltage in response to the transfer current; and a sub-protection circuit configured to generate and provide the protection voltage in response to the driving voltage when the transfer current is not formed.

8. The display driving apparatus of claim 7, wherein the core protection circuit comprises:

a second high voltage device configured to generate a core protection current in response to the transfer current; and a third high voltage device configured to generate the protection voltage in response to the core protection current.

9. The display driving apparatus of claim 7, wherein the sub-protection circuit comprises:

a first switching device and a second switching device configured to receive the driving voltage in parallel and to act as resistance by being turned on in response to a first ground voltage for the low voltage power;

a first sub-protection device having a drain to which the first switching device is connected and a gate to which the second switching device is connected, and configured to generate the protection voltage corresponding to the driving voltage by being turned on when the driving voltage is applied to the second switching device; and a second sub-protection device having a drain to which the second switching device is connected, and configured to share the protection voltage along with the protection device through a gate thereof and to control the application of the driving voltage to the second switching device and the generation of the protection voltage by the first sub-protection device, in response to a level of the protection voltage.

10. The display driving apparatus of claim 2, wherein:

the first low voltage device operates in a range of the operating voltage and the first ground voltage for the low voltage power, and the transfer current generator is driven by the driving voltage for the high voltage power and the first ground voltage for the low voltage power.

11. A current bias circuit of a display driving apparatus, comprising:

a bias core configured to provide a core current based on low voltage power;

a current conversion circuit configured to generate a transfer current based on a driving voltage for high voltage power in response to the core current; and a high voltage bias unit configured to generate a high voltage bias current based on the driving voltage in response to the transfer current, wherein the current conversion circuit is driven by the driving voltage for the high voltage power and a first ground voltage for the low voltage power.

12. The current bias circuit of claim 11, wherein the current conversion circuit comprises:

a reference current generator configured to generate a low voltage bias reference current based on an operating voltage for the low voltage power in response to the core current; and a transfer current generator configured comprising a first low voltage device turned on in response to the low voltage bias reference current and operating in a range of the operating voltage and the first ground voltage for the low voltage power, and configured to generate the transfer current based on the driving voltage in response to the low voltage bias reference current, and to perform protection for dropping the driving voltage applied to the first low voltage device.

13. The current bias circuit of claim 12, wherein the transfer current generator comprises:

the first low voltage device turned on in response to the low voltage bias reference current;

a first high voltage device configured to generate the transfer current based on the driving voltage in response to the turn-on of the first low voltage device; and a protection device configured between the first low voltage device and the first high voltage device, and configured to maintain a turn-on in response to the operating voltage lower than the driving voltage and to perform protection for dropping the driving voltage applied to the first low voltage device.

14. The current bias circuit of claim 12, wherein the transfer current generator comprises:

the first low voltage device turned on in response to the low voltage bias reference current;

a first high voltage device configured to generate the transfer current based on the driving voltage in response to the turn-on of the first low voltage device;

a protection device configured between the first low voltage device and the first high voltage device, and configured to maintain a turn-on in response to a protection voltage and to perform protection for dropping the driving voltage applied to the first low voltage device; and a protection control circuit configured to provide the protection voltage based on the transfer current or the driving voltage depending on whether the transfer current is formed.

15. The current bias circuit of claim 14, wherein:

the protection control circuit comprises:

a core protection circuit configured to generate and provide the protection voltage in response to the transfer current, and a sub-protection circuit configured to generate and provide the protection voltage in response to the driving voltage when the transfer current is not formed;

the core protection circuit comprises:

a second high voltage device configured to generate a core protection current in response to the transfer current, and a third high voltage device configured to generate the protection voltage in response to the core protection current; and the sub-protection circuit comprises:

a first switching device and a second switching device configured to receive the driving voltage in parallel and to act as resistance by being turned on in response to the first ground voltage, a first sub-protection device having a drain to which the first switching device is connected and a gate to which the second switching device is connected, and configured to generate the protection voltage corresponding to the driving voltage by being turned on when the driving voltage is applied to the second switching device, and a second sub-protection device having a drain to which the second switching device is connected, and configured to share the protection voltage along with the protection device through a gate thereof and to control the application of the driving voltage to the second switching device and the generation of the protection voltage by the first sub-protection device, in response to a level of the protection voltage.

* * * * *